US006297783B1

(12) United States Patent
Bäck et al.

(10) Patent No.: US 6,297,783 B1
(45) Date of Patent: Oct. 2, 2001

(54) ANTENNA ARRANGEMENT AND A METHOD IN CONNECTION WITH THE ANTENNA ARRANGEMENT

(75) Inventors: Ingemar Bäck, Åkersberga; Ola Forslund, Sundbyberg; Joakim Olofsson, Uppsala; Per Sjöstrand, Stockholm, all of (SE)

(73) Assignee: Celsiustech Electronics AB, Jarfalla (SE)

( * ) Notice: Subject to any disclaimer, the term of this patent is extended or adjusted under 35 U.S.C. 154(b) by 0 days.

(21) Appl. No.: 09/582,093

(22) PCT Filed: Dec. 21, 1998

(86) PCT No.: PCT/SE98/02400

§ 371 Date: Aug. 24, 2000

§ 102(e) Date: Aug. 24, 2000

(87) PCT Pub. No.: WO99/36990

PCT Pub. Date: Jul. 22, 1999

(30) Foreign Application Priority Data

Dec. 29, 1997 (SE) ..... 9704891

(51) Int. Cl.[7] ..... H01Q 13/00
(52) U.S. Cl. ..... 343/778; 343/776
(58) Field of Search ..... 343/776, 778, 343/779, 781 R, 781 CA, 772

(56) References Cited

U.S. PATENT DOCUMENTS

| | | | | |
|---|---|---|---|---|
| 3,611,396 | * | 10/1971 | Jones, Jr. | 343/776 |
| 3,955,202 | * | 5/1976 | Young | 343/756 |
| 4,308,538 | | 12/1981 | Albersheim | 343/16 M |
| 5,467,072 | | 11/1995 | Michael | 340/436 |
| 5,963,174 | | 10/1999 | Larsson et al. | 343/766 |

FOREIGN PATENT DOCUMENTS

WO 96/36088 11/1996 (WO) ..... H01Q/3/26

OTHER PUBLICATIONS

IEEE Standard, "Test Procedures for Antennas", ANSI/IEEE std. 149–1979, ISBN 0–471–08032–2.

* cited by examiner

*Primary Examiner*—Don Wong
*Assistant Examiner*—Huang Nguyen
(74) *Attorney, Agent, or Firm*—Connolly Bove Lodge & Hutz

(57) ABSTRACT

An antenna device for emitting and/or receiving electromagnetic radiation, such as radar radiation in a car radar apparatus is provided. Sweeping is realized by means of a fixed feeder and a rotatable reflector. The reflector is driven by a drive motor and its motion is monitored by a tachometer. The drive motor and the tachometer are constituted by so-called flag motors which are mutually motionally coupled to each other by mechanical means.

21 Claims, 3 Drawing Sheets

ANTENNA ARRANGEMENT AND A METHOD IN CONNECTION WITH THE ANTENNA ARRANGEMENT

Figure 1:
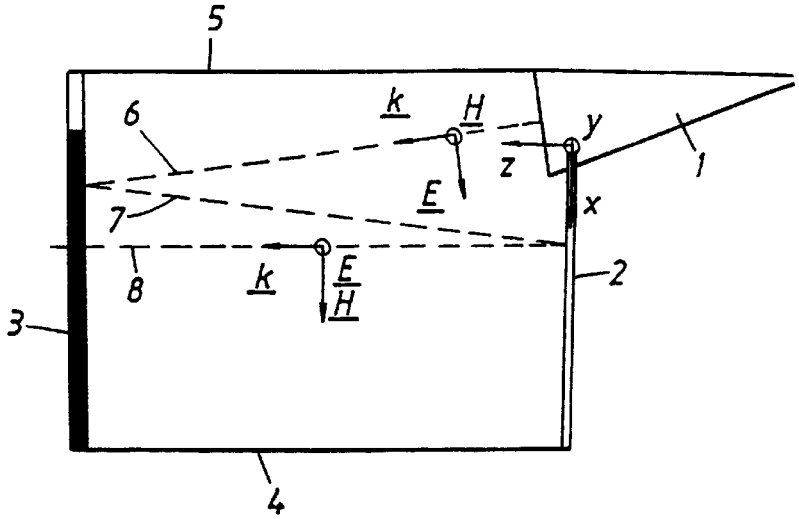

The present invention relates to a method of, in an antenna arrangement which comprises a feeder network, a radiating element and a reflector system and scans space in a first plane, bringing about increased resolution in a second plane at right angles to the first plane. The invention also relates to an antenna arrangement forming part of an auxiliary system, working according to radar principles, for vehicles, which arrangement is connected to a signal source and/or a signal receiver and comprises a feeder network, a radiating element and also a reflector system for distributing output power from the radiating element or, respectively, focusing incoming radiation from space onto the radiating element.

An antenna arrangement according to the above is previously known from our earlier Swedish Patent 505 599. The antenna has a disc-shaped lobe and is intended to scan an area in the horizontal plane of the order of 10–15 degrees. This is brought about by rotating the main reflector in a reflector system of the Cassegrain type.

The known antenna arrangement has no resolution in the elevation direction. It has, however, become desirable to be able to equip the known type of antenna arrangement with some form of elevation resolution. By introducing elevation resolution, the antenna arrangement can be used in order to distinguish stationary objects on the roadway, e.g. cars, from objects above the roadway, e.g. bridges and road signs.

The object of the present invention is to produce a method and an antenna arrangement which not only afford resolution in a first plane, preferably the horizontal plane, but also afford at least limited resolution in a plane at right angles to the first plane, preferably the vertical plane. The object of the invention is achieved by a method characterized in that the phase center of the radiating element is moved relative to the reflector system in the elevation plane by dividing the radiating element and feeding the divided radiating element according to at least a first and a second power distribution model, and also an antenna arrangement characterized in that the radiating element is designed so as to be divided into at least two radiating part-elements and in that the feeder network comprises a distribution network adapted to distribute the signal power between the radiating part-elements according to at least two different power distribution models.

In this context, phase center means a point in space, which is fixed in relation to the antenna. For this point, it is ideally true that the wave radiated from the antenna has the same phase position on all spheres with their center point at this point. The point can also be regarded as the point where radiation takes place, i.e. the origin of the radiation. For the great majority of antennas, there is no such point but, if the phase position is constant over that part of the sphere which is delimited by the main lobe, the center point of the sphere is still called the phase center of the antenna. For a more detailed description of the phase center, refer to IEEE Standard Test Procedures for Antennas, ANSI/IEEE Std 149-1979, ISBN 0-471-08032-2.

The two power distribution models result in the generation of two different lobes in elevation. In this connection, it is possible to make one lobe, the normal lobe, point absolutely horizontally, while the second lobe, the elevation lobe, can point slightly upwards, e.g. 2–4 degrees above the horizontal plane. Both the lobes can be scanned in azimuth.

The distribution of power between the divided radiating elements can be effected stepwise or continuously according to the desired type of sweep of the lobe(s) of the antenna arrangement. According to a preferred embodiment, the power is distributed between the radiating part-elements so that, for generating the elevation lobe, all the power is assigned to only one radiating part-element while, for the normal lobe, the power is distributed between two radiating part-elements so that both part-elements receive power.

The embodiment of the radiating element of the antenna arrangement may vary in many respects. For example, according to an envisaged embodiment, the antenna arrangement may comprise a separate radiating element for receiving and a separate one for transmitting and either one radiating element or both can be divided into two radiating part-elements. The possibility of varying the design of the radiating elements within wide limits allows, inter alia, the cost of the total number of components that are required to be kept down.

According to an advantageous embodiment, the radiating part-elements consist of horns. The reflector system of the antenna arrangement can be of the Cassegrain type for distributing or, respectively, focusing the radiation, and a combination of horns as radiating part-elements with a reflector system of the Cassegrain type has proved to be advantageous.

In order to distribute the signal power between the radiating part-elements according to two power distribution models, the distribution network comprises, according to another advantageous embodiment, a first and a second hybrid and a phase rotator, one output on the first hybrid being connected directly to one input on the second hybrid and the other output on the first hybrid being connected to the other input on the second hybrid via the phase rotator. The phase rotator can be variable. By varying the phase rotation in the variable phase rotator, the power can be distributed arbitrarily between two associated radiating part-elements. Advantageously, the phase rotator can be assigned a first and a second fixed position so that, in the first position, the power is distributed between the radiating part-elements and, in the second position, all the power is fed to one of the radiating elements.

Advantageously, the phase rotator consists of a third hybrid provided with a first and a second waveguide on the output side and a short circuit which can be introduced into each waveguide. So as to allow introduction of the short circuits into the waveguides, the latter are preferably provided with slots in two opposite delimiting surfaces at those ends of the waveguides which are distant from the hybrid. According to the proposed embodiment, the short circuits can be introduced by a linear movement or by a movement following the arc of a circle. According to a specific preferred embodiment, the short circuits are arranged in association with the periphery of a rotatable circular disc, the peripheral part of which passes through the slots of the waveguides during rotation. In this connection, the circular disc can constitute a part of the rotor in a motor included for rotating the disc. The material in the disc should have a low dielectric constant. Expediently, the short circuits consist of metal strips, such as copper strips.

By virtue of the embodiment according to the previous paragraph, the short circuits can be made very much alike in the two waveguides and good matching is achieved automatically. Integration of motor and disc has proved to be advantageous, inter alia with regard to moment of inertia, power requirement and heat generation.

The hybrids can consist of 90 degree hybrids, but it is also possible to introduce another hybrid type, for example 180 degree hybrids.

Figure 2B:
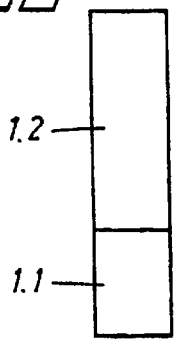
Figure 2A:
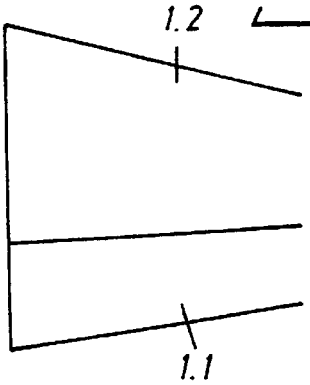
Figure 3:
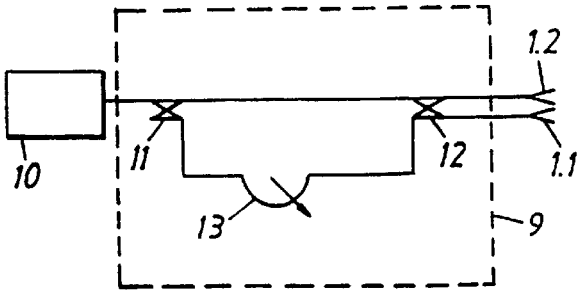
Figure 4A:
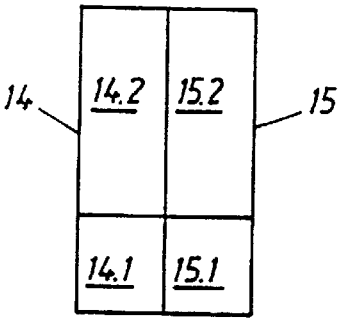
Figure 4B:
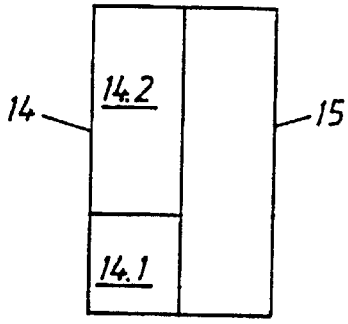
Figure 5:
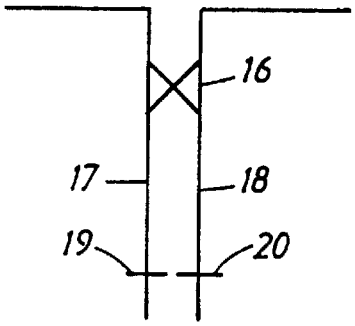
Figure 6A:
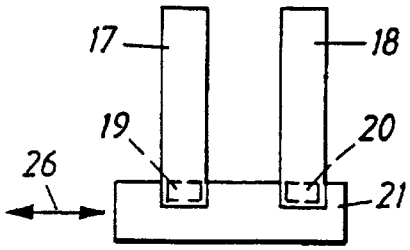
Figure 6B:
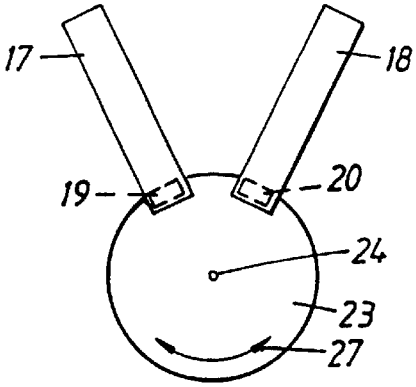
Figure 6C:
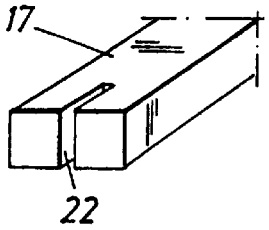
Figure 7:
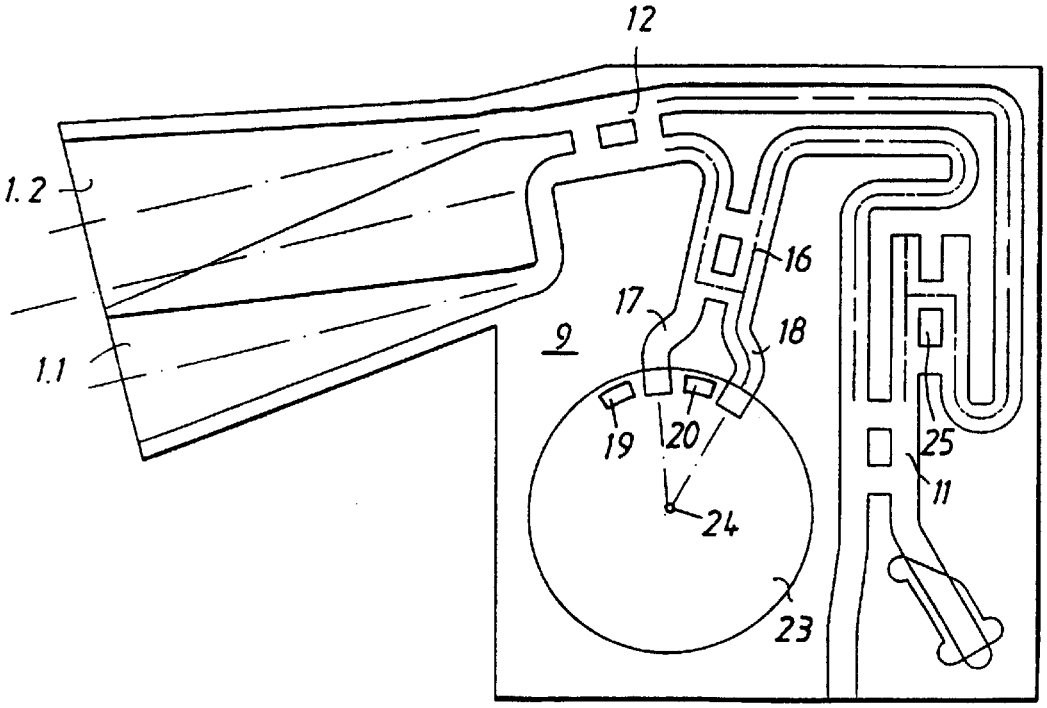

The invention is described in greater detail below by means of an exemplary embodiment with reference to the appended drawings, in which:

FIG. 1 shows a known reflector antenna of the Cassegrain type,

FIG. 2 shows diagrammatically in a front view and a side view a radiating element according to the principles of the invention, divided into two radiating part-elements, FIG. 3 shows a diagrammatic sketch of the feeder network, FIGS. 4*a* and 4*b* show diagrammatically in a front view second and a third exemplary embodiment of the design of the radiating elements, FIG. 5 shows a diagrammatic representation of a phase rotator coupling with displaceable short circuits, FIG. 6*a* shows an exemplary embodiment of a phase rotator coupling with linearly displaceable short circuits, FIG. 6*b* shows an exemplary embodiment of a phase rotator coupling with short circuits which can be displaced along a circular arc, FIG. 6*c* shows in a perspective view part of a waveguide included in a phase rotator coupling according to FIG. 6*a* or 6*b*, and FIG. 7 shows diagrammatically a phase rotator coupling according to FIG. 6*b* integrated in a feeder network with horn antennas.

The known reflector antenna of the Cassegrain type shown in FIG. 1 comprises a radiating element in the form of a horn 1, a main reflector 2, and a subreflector 3, which two reflectors constitute the reflector system of the reflector antenna. The subreflector 3, together with a bottom part 4, a top part 5 and side walls (not shown in greater detail) form the outer delimitation of the antenna unit. The main reflector 2 acts electrically like a plane here and the subreflector 3 is of cylindrical parabolic shape. It may be pointed out that it is also possible to use a main reflector of appropriate curved shape, for example parabolic shape. The antenna is horizontally polarized. By interaction between the horn and the reflectors, a disc-shaped lobe (not shown) is produced, which is intended to scan an area in the horizontal plane. The scanning in the horizontal plane is brought about by the main reflector being arranged rotatably, for example ±6–7° about a vertical central axis, the antenna being steerable through ± double the angle in the horizontal plane. A suitable frequency range for the antenna is 76–77 GHz.

Furthermore, the main reflector rotates polarization by 90°. It is also focusing in the vertical direction. The subreflector has a focusing effect in the horizontal direction. It is what is known as a transreflector, i.e. it acts in a reflecting manner with regard to one polarization (linear vertical) while it is transparent with regard to the orthogonal one (linear horizontal). Reflection of the vertical polarization is brought about by means of a vertically etched strip pattern. In the figure, the ray path has been shown by means of broken lines 6, 7 and 8 and the E and H fields have been marked by arrows. In this connection, it can be seen from these indications that the radiation undergoes polarization rotation of 90 degrees in the main reflector between the broken lines 7 and 8.

The reflector system 2, 3 is offset-fed via the radiating element in the form of a waveguide-based vertically polarized sectoral E-plane horn. The purpose of offset feeding is on the one hand to ensure a low standing-wave ratio, SWR, and on the other hand to avoid feeder blocking for as long as possible.

If the antenna is regarded as a transmitting antenna, the operation of the antenna can be explained as follows: a vertically polarized wave initiated from a signal source and originating from the feeder horn 1 is reflected in the subreflector 3 and is focused with regard to the horizontal plane. The plane vertically polarized wave originating from the subreflector is reflected and is then rotated in polarization in the main reflector 2, after which it passes out through the subreflector.

A prerequisite for the lobe of the antenna described above to lie in the horizontal plane is that the phase center of the feeder horn 1 lies at the focal point of the reflector system. If the feeder horn 1 is moved slightly downwards so that the phase center of the horn is then below the focal point, the lobe will point slightly upwards. The distance from the focal point determines the angle of the lobe in the elevation direction.

Our idea for achieving elevation resolution is based on dividing the radiating element into radiating part-elements. FIG. 2 shows diagrammatically the division of a radiating element in the form of a feeder horn into two smaller horns 1.1, 1.2 separated in the vertical direction, the left part showing a front view of the horns and the right part a side view of the horns. By distributing the power arbitrarily between the two horns, scanning in the elevation direction between a maximum and a minimum angle is brought about. In order to obtain a lobe in the horizontal plane, the power is distributed between the two horns so that the combined radiation from the horns has its phase center at the focal point. If all the power is distributed to the lower horn, the lobe will point slightly upwards. According to a proposal for dividing the feeder horn, the upper horn is provided with an aperture which is at least twice the size of that of the lower horn by means of increased extent in the vertical plane. Distribution of the available power so that roughly −1.5 dB is fed to the upper horn and roughly −5.2 dB is fed to the lower horn can cause the phase center of the combined radiation to lie at the focal point. If all the power is fed to the lower horn, the phase center of the radiation will then be below the focal point. This leads to an elevation lobe being generated, which points a few degrees above the horizontal plane.

FIG. 3 shows a diagrammatic sketch of a suitable feeder network 9 for feeding a divided radiating element in the form of a lower and an upper horn 1.1, 1.2. The feeder network 9 is connected to a signal source 10 in the form of a signal generator. The feeder network comprises a distribution network, which in the diagrammatic sketch is identical with the feeder network, for distributing the power between the upper and lower horn. The distribution network comprises two 90 degree hybrids 11, 12 and a variable phase rotator 13.

In this connection, hybrid means a component which divides incoming line-conducted microwave energy between two outgoing lines. The power values in the two outgoing lines are the same but are phase-rotated in relation to one another. The hybrids are divided into two different groups depending on the phase difference in the two outgoing lines, that is to say 90 degree hybrids and 180 degree hybrids, resulting in a 90 degree or, respectively, a 180 degree phase difference between the outgoing lines of the hybrid. The hybrids are in most cases provided with two inputs and two outputs and are standard components for the microwave designer.

Incoming power from the signal source 10 is fed into the first 90 degree hybrid 11, one output of which is connected directly to one input on the second 90 degree hybrid and the other output of which is connected, via the phase rotator 13, to the other input on the second hybrid 12. The first output of the second hybrid is connected to the upper horn 1.2 and the second output is connected to the lower horn 1.1.

By varying the phase rotation in the variable phase rotator 13, the output power from the signal source 10 can be distributed arbitrarily between the two horns 1.1, 1.2. The variable phase rotator can be given two fixed positions, a first in which the power is distributed between the upper and lower horn and a second in which all the power is distributed to the lower horn. Switching between these two fixed positions means that the antenna lobe is moved between two different elevation angles, e.g. between a normal lobe in the horizontal plane, the first position, and an elevation lobe pointing a few degrees upwards relative to the horizontal plane, the second position.

In the event that the antenna functions as a receiving antenna, signals received by the horns 1.1, 1.2 from free space are supplied via the distribution network to a signal receiver (not shown) connected on the same side of the distribution network as the signal source.

According to the front view of the radiating elements of the antenna arrangement in a second exemplary embodiment shown in FIG. 4*a*, the antenna arrangement has been provided with two radiating elements 14 and 15, one being used for transmitting and the other for receiving. The two radiating elements 14, 15 are divided into radiating part-elements 14.1, 14.2 and, respectively, 15.1, 15.2 arranged one above the other. The distribution of power between an upper and a lower part-element that belong together takes place according to the same principles as were described above for an embodiment with a common radiating element for transmitting and receiving.

FIG. 4*b* shows a third exemplary embodiment of the design of the radiating elements. Like the exemplary embodiment according to FIG. 4*a*, the antenna arrangement has been provided with two radiating elements 14, 15. One radiating element is intended for transmitting and the other for receiving. In this case, only one 14 of the radiating elements is divided into part-elements 14.1, 14.2. Here, the radiating element 14 can be used for transmitting and the radiating element 15 for receiving. The reverse, using the radiating element 15 for transmitting and the radiating element 14 for receiving, is also possible. By forgoing dividing one radiating element 15 into part-elements, the number of components required can be reduced. However, a reduced sweep in the elevation direction can be expected.

Examples of how the phase rotator 13 included according to FIG. 3 can be designed are described in greater detail below with reference to FIGS. 5, 6*a*, 6*b*, 6*c* and 7.

According to FIG. 5, which illustrates the principle itself, the phase rotation is effected by means of a hybrid 16 with a first and a second waveguide 17, 18 on the output side of the hybrid, into which waveguides short circuits 19, 20 can be introduced. In order to bring about short circuiting, it is only necessary to introduce a sufficiently large metal strip into the middle of the E plane of the waveguide. On the input side, the hybrid is connected to the first and second hybrid 11 and 12 respectively in the manner shown in FIG. 3. By introducing the short circuits, the waveguides are shortened in terms of conduction and a phase shift is thus brought about in comparison with the situation when the waveguides are allowed to operate unshortened.

FIG. 6*a* shows an example of how the short circuits can be introduced into the waveguides by means of a linear movement. A linearly displaceable plate 21 with a low dielectric constant is provided with short circuits 19, 20 in the form of metal strips. The plate 21 is displaceable across two parallel waveguides 17, 18 in the direction indicated by the arrow 26. Parts of the plate 21 run in slots 22 arranged in those ends of the waveguides which are distant from the hybrid. The design of the slots 22 can be seen best in the perspective view shown in FIG. 6*c* of one end of a waveguide. A first fixed position of the phase rotator is defined by the short circuits being located completely outside the waveguides and a second position is defined by the state shown in FIG. 6*a* where the short circuits are introduced into the waveguides.

According to the exemplary embodiment shown in FIG. 6*b*, the waveguides 17 and 18 are directed in towards the center of rotation 24 of a rotatable disc 23 with a low dielectric constant. An arrow 27 indicates the rotary movement of the disc. Two short circuits 19, 20 are arranged on the disc 23. Similarly to what has been described previously, the waveguides are provided with slots 22. By rotating the disc about the center of rotation of the disc, the phase rotator can be made to adopt two fixed positions, one in which the short circuits 19, 20 are located completely outside the waveguides and one in which the short circuits are introduced into the waveguides. The rotation of the disc 23 can be brought about by, for example, a stepping motor connected to the disc. Alternatively, the disc can be integrated into the rotor part of the stepping motor.

By way of suggestion, a suitable material with a low dielectric constant for the plate 21 or, respectively, the disc 23 is Duroid 5880. When the metal strip is moved out of the waveguide, only material with a low dielectric constant will be situated in the waveguide within the slot 22, which does not have any appreciable effect on the waveguide. This situation means that the waveguide is not appreciably affected by the plate or the disc.

In FIG. 7, the phase rotator coupling according to FIG. 6*b* has been integrated into a feeder network 9 with horn antennas 1.1, 1.2. The disc 23 with the metal strips 19, 20 is shown here in a position in which the metal strips lie completely outside the waveguides. The figure proposes a possible waveguide pattern. It may be noted in particular that a fourth hybrid 25 has been added in order to bring about better matching. Both the third and fourth hybrids preferably consist of hybrids with 90 degree phase rotation.

Using short circuiting according to the above, it is possible to bring about very coordinated and uniform phase rotation with good matching without any special measures.

The exemplary embodiment described above applying our inventive idea is not to be regarded as limiting for the invention, but a number of alternative embodiments are contained within the scope of the invention, as defined in the patent claims appended to the description. The reflector system does not have to consist of a Cassegrain configuration, but other reflector systems are possible, such as, for example, different systems of single-curved, double-curved and/or plane reflecting surfaces intended to distribute the power from the radiating element in a desired manner in space or alternatively to focus incoming radiation from space onto the radiating element. The radiating element does not have to consist of horns, but all other types of radiating elements can be considered, for example radiating elements based on patch technology.

What is claimed is:

1. Method of, in an antenna arrangement which comprises a feeder network, a radiating element and a reflector system and scans space in a first plane, bringing about increased resolution in a second plane at right angles to the first plane, characterized in that the phase center of the radiating element is moved relative to the reflector system in the elevation plane by dividing the radiating element and feeding the divided radiating element according to at least a first and a second power distribution model.

2. Method according to claim 1, characterized in that the distribution of power between the divided radiating elements is switched in steps for stepwise movement of the lobe of the antenna arrangement.

3. Method according to claim 1, characterized in that, according to the first power distribution model, all the power is distributed to only one divided part of the radiating element and in that, according to the second power distribution model, the power is distributed between the divided parts of the radiating element so that each divided part is assigned power according to a fixed mutual ratio.

4. Method according to claim 1, characterized in that the distribution of power between the divided radiating elements is changed continuously for generation of a continuous sweep of the lobe of the antenna arrangement.

5. Antenna arrangement forming part of an auxiliary system, working according to radar principles, for vehicles, which arrangement is connected to a signal source and/or a signal receiver and comprises a feeder network, a radiating element and also a reflector system for distributing output power from the radiating element or, respectively, focusing incoming radiation from space onto the radiating element, characterized in that the radiating element is designed so as to be divided into at least two radiating part-elements and in that the feeder network comprises a distribution network adapted to distribute the signal power between the radiating part-elements according to at least two different power distribution models.

6. Antenna arrangement according to claim 5, characterized in that the radiating element is divided into two part-elements arranged one above the other.

7. Antenna arrangement according to claim 5, characterized in that the antenna arrangement comprises a separate radiating element for receiving and one for transmitting and in that at least one of the two separate radiating elements is designed so as to be divided into two radiating part-elements.

8. Antenna arrangement according to claim 5, characterized in that the radiating part-elements consist of horns.

9. Antenna arrangement according to claim 5, characterized in that the distribution network comprises a first and a second hybrid and a phase rotator, one output on the first hybrid being connected directly to one input on the second hybrid and the other output on the first hybrid being connected to the other input on the second hybrid via the phase rotator.

10. Antenna arrangement according to claim 9, characterized in that the hybrids are 90 degree hybrids.

11. Antenna arrangement according to claim 9, characterized in that the phase rotator is variable.

12. Antenna arrangement according to claim 9, characterized in that the phase rotator comprises a first and a second fixed position, in which first position the power is distributed between the radiating part-elements and in which second position all the power is fed to one of the radiating part-elements.

13. Antenna arrangement according to claim 9, characterized in that the phase rotator consists of a third hybrid provided with a first and a second waveguide on the output side and a short circuit which can be introduced into each waveguide.

14. Antenna arrangement according to claim 13, characterized in that those ends of the first and second waveguide which are distant from the hybrid are provided with slots in two opposite delimiting surfaces of the waveguides, which slots are dimensioned to allow introduction of short circuits.

15. Antenna arrangement according to claim 13, characterized in that the short circuits are arranged so as to be introduced into the waveguides by a linear movement.

16. Antenna arrangement according to claim 13, characterized in that the short circuits are arranged so as to be introduced by a movement following the arc of a circle.

17. Antenna arrangement according to claim 16, characterized in that the short circuits are arranged in association with the periphery of a circular disc which is rotatable about a center of rotation and the peripheral part of which passes through the slots of the waveguides during rotation.

18. Antenna arrangement according to claim 17, characterized in that the circular disc constitutes a part of the rotor in a motor included for rotating the disc.

19. Antenna arrangement according to claim 17, characterized in that the circular disc consists of a material with a low dielectric constant.

20. Antenna arrangement according to claim 13, characterized in that the short circuits consist of metal strips, such as copper strips.

21. Antenna arrangement according to claim 5, characterized in that the reflector system is of the Cassegrain type for distributing or, respectively, focusing the radiation.

* * * * *